US006672913B1

(12) United States Patent
Wang

(10) Patent No.: US 6,672,913 B1
(45) Date of Patent: Jan. 6, 2004

(54) PLUG CONNECTOR AND METHOD FOR MANUFACTURING THE SAME

(75) Inventor: Wei Che Wang, Tu-Chen (TW)

(73) Assignee: Hon Hai Precision Ind, Co., Ltd., Taipei Hsien (TW)

( * ) Notice: Subject to any disclaimer, the term of this patent is extended or adjusted under 35 U.S.C. 154(b) by 0 days.

(21) Appl. No.: 10/324,170

(22) Filed: Dec. 18, 2002

(30) Foreign Application Priority Data

Nov. 29, 2002 (TW) ..... 91134728

(51) Int. Cl.[7] ..... H01R 4/02
(52) U.S. Cl. ..... 439/874; 439/580; 439/675
(58) Field of Search ..... 439/874, 578, 439/580, 610, 675, 63

(56) References Cited

U.S. PATENT DOCUMENTS 4,397,516 A * 8/1983 Koren et al. ..... 439/610
4,519,666 A * 5/1985 Williams et al. ..... 439/578
4,869,690 A * 9/1989 Frear et al. ..... 439/675
5,885,104 A 3/1999 Foster et al.
6,443,763 B1 * 9/2002 Richet ..... 439/580

* cited by examiner

*Primary Examiner*—P. Austin Bradley
*Assistant Examiner*—Felix O. Figueroa
(74) *Attorney, Agent, or Firm*—Wei Te Chung

(57) ABSTRACT

A plug connector (1) includes an insulative housing (2), a center contact (3), an inner contact (4) and an outer contact (5). The housing defines a cutout (23) at a rear end thereof. The center contact has a U shaped tail portion (32) at a rear end thereof, a mating portion (35) for electrically engaging with a complementary connector and an intermediate portion (31) embedded in the housing and connecting the tail portion and the mating portion. The inner contact and the center contact are insert molded with the housing. The inner contact has a mating face (42) exposed in the cutout at a rear end thereof. The outer contact has a reversed U shaped tongue (53) facing opposite to the tail portion of the center contact and extending from a rear end thereof.

4 Claims, 7 Drawing Sheets

PLUG CONNECTOR AND METHOD FOR MANUFACTURING THE SAME

BACKGROUND OF THE INVENTION

1. Field of the Invention

The present invention relates to an electrical plug connector, and particularly to an electrical plug connector for an electrical cable having multiple wires.

2. Description of Related Art

Electrical plug connectors are used to terminate electrical cables and mate with complementary receptacle connectors to electrically and separably connect the electrical cables and the complementary receptacle connectors. One type of electrical plug connector, Direct Current (DC) plug connector is shown in U.S. Pat. No. 5,885,104 issued on Mar. 23, 1999 to Foster et al. and includes outer and inner cylindrical contacts surrounding a center contact thereof. The center contact includes a crimping portion for crimping termination to a core conductor of a cable which is terminated by the DC plug connector. A pair of additional terminals electrically connect the outer and inner contacts and have crimping portions to crimp the outer and inner contacts with corresponding conductors of the cable. Such connection between the contacts and the conductors is readily broken or misaligned by an external force applied to the connector, thereby badly affecting the electrical performance of the connector.

Furthermore, in order to achieve a more reliable electrical connection, electrical contacts of an electrical plug connector sometimes have tail portions thereof soldered to conductors of a cable which is terminated by the electrical plug connector. However, a tail portion of a center contact of the electrical plug connector is usually positioned adjacent to tail portions of inner or outer contacts, and in the course of fixing the conductors to contacts of the plug connector, the conductors have a chance to connect the inner or outer contacts or the center contact to form a short circuit between the contacts.

Hence, an improved plug connector is desired.

SUMMARY OF THE INVENTION

Accordingly, an object of the present invention is to provide a reliable plug connector which avoids short circuit between contacts thereof.

In order to achieve the object set forth, a plug connector includes a generally cylindrical insulative housing, a center contact retained by the housing, an inner contact and an outer contact. The housing is made of synthetic resin and has a front end, a rear end, a space defined in the front end thereof and a cutout defined on the rear end of the housing. The center contact has a U shaped tail portion protruding outwardly from the rear end of the housing, a mating portion extending into the space for electrically engaging with a corresponding element of a complementary connector and an intermediate portion embedded in the housing and connecting the tail portion and the mating portion. The inner contact is made of metal and is generally of hollow cylinder configuration to surround the center contact. The outer contact has a reversed U shaped tongue extending from a rear end there. The inner contact has a mating face exposed in the cutout of the housing and is properly distanced from the outer contact and the center contact.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
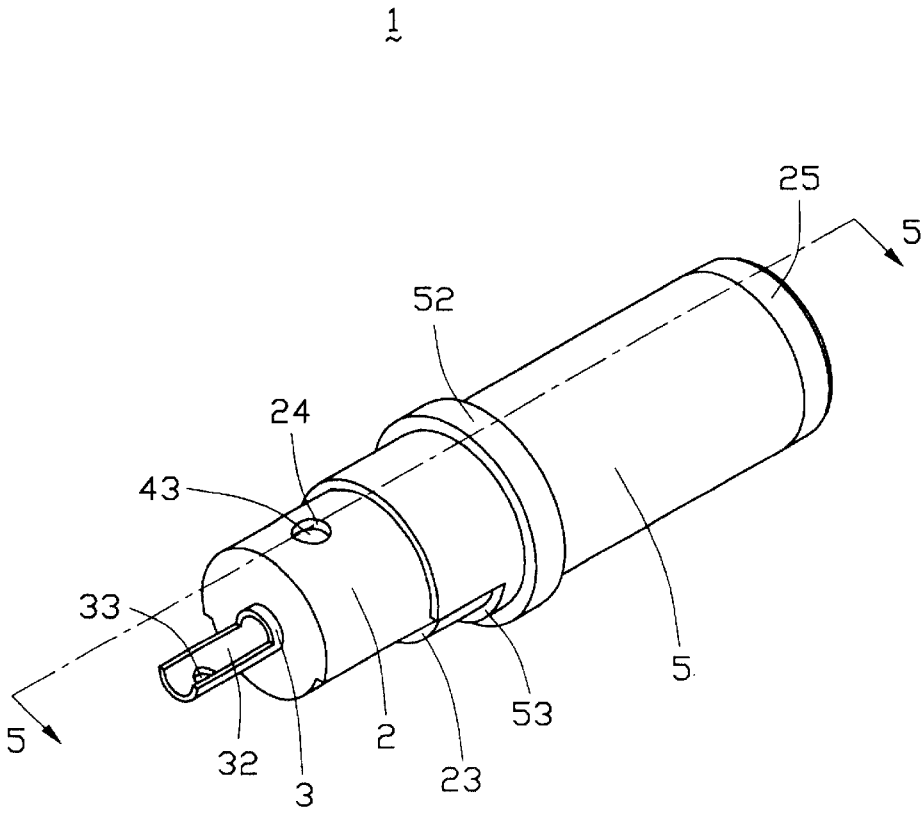
FIG. 1 is a perspective view of a plug connector in accordance with a first embodiment of the present invention.
Figure 2:
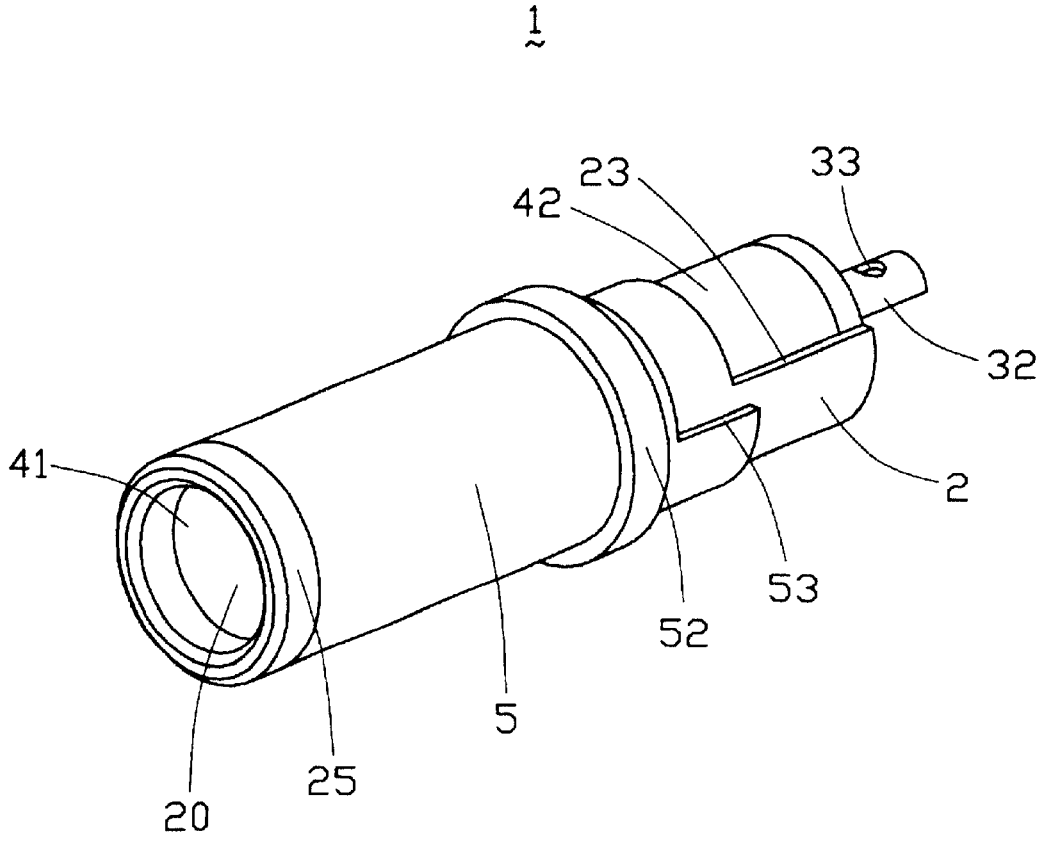
FIG. 2 is a view similar to FIG. 1 but from a different perspective.

Referring to the drawings in greater detail, and to FIGS. 1–4, a Direct Current (DC) plug connector 1 in accordance with a first embodiment of the present invention for terminating to one end of an electrical cable (not shown) and mating with a complementary receptacle connector (not shown) is shown. The connector 1 includes a generally cylindrical insulative housing 2 or called insulator 2, a center contact 3 accommodated by the housing 2, an inner contact 4 and an outer contact 5.

Figure 5:
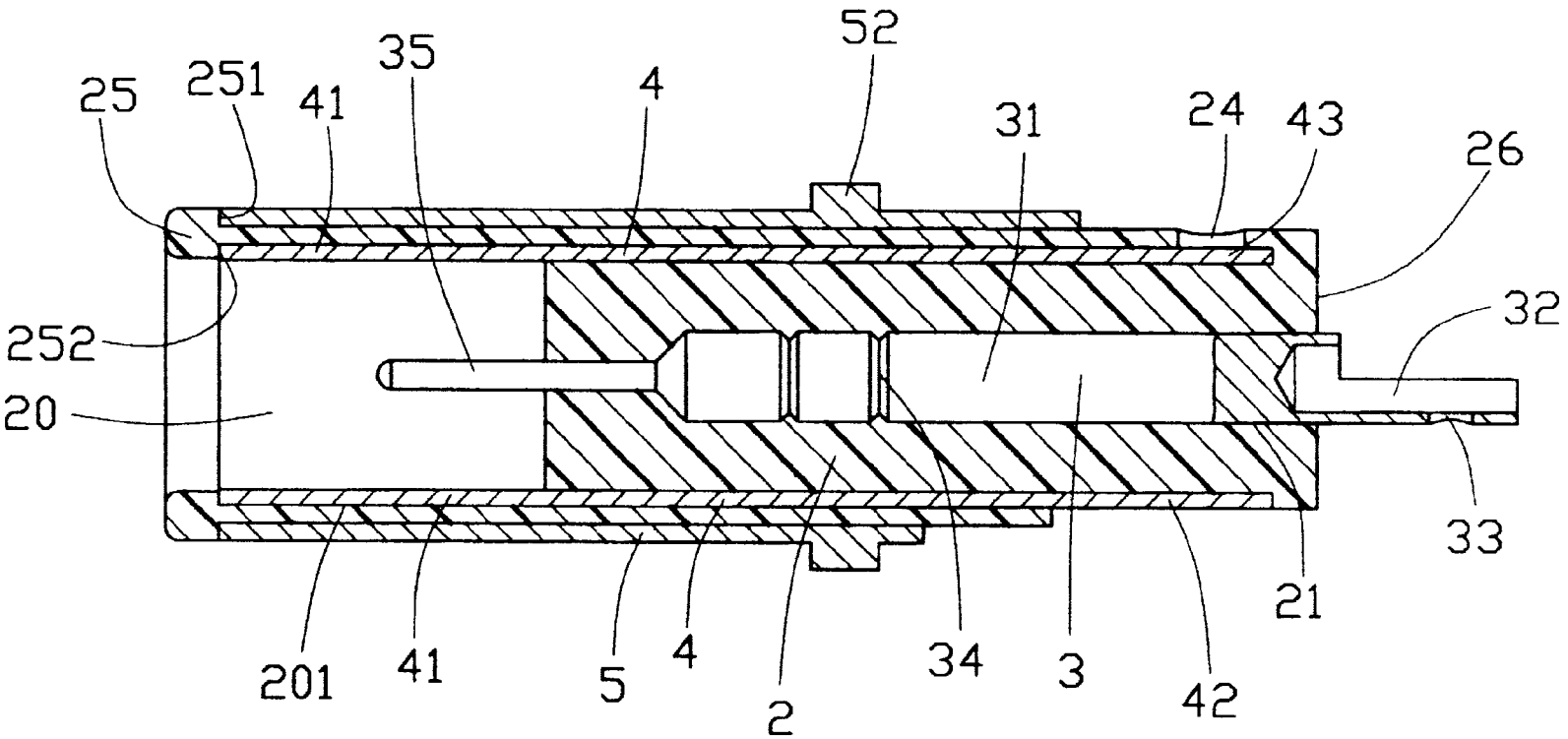
FIG. 5 is a cross-sectional view taken along line 5—5 of FIG. 1.

Also referring to FIG. 5, the housing 2 is made of synthetic resin. The housing 2 has a front end 25, a rear end 26, and a space 20 defined in the front end 25 thereof. The housing 2 defines a cutout 23 in one side of the rear end 26, a hole 24 on an opposite side of the rear end 26 thereof for providing a positioning during insert molding process, and a bore 21 extending longitudinally through the rear end 26 thereof. The front end 25 has an outer protrusion 251 protruding outwardly from an outer surface thereof and an inner protrusion 252 protruding inwardly from an inner surface thereof into the space 20.

Figure 3:
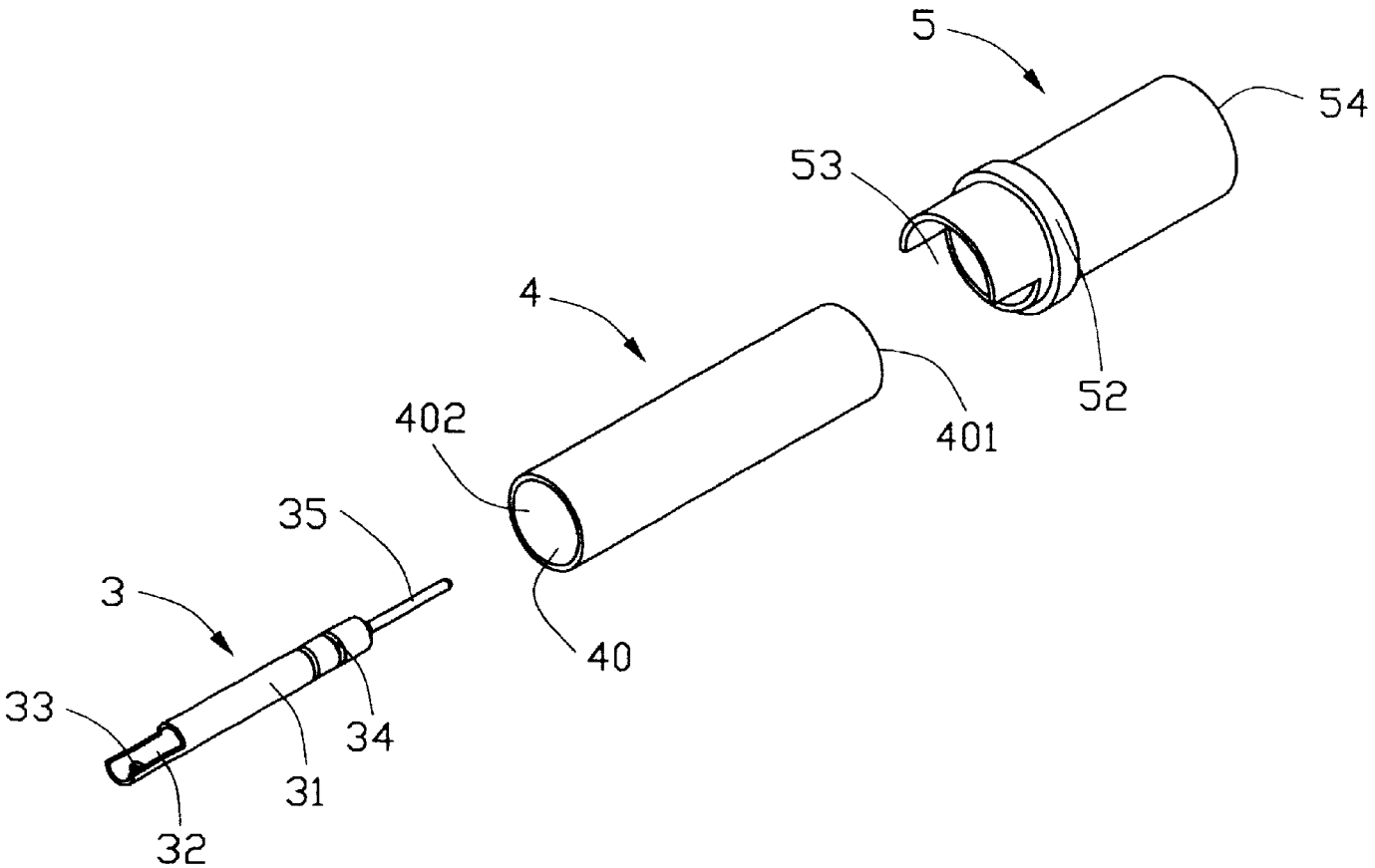
FIG. 3 is an exploded perspective view of the plug connector of FIG. 1 before inserting molding.
Figure 4:
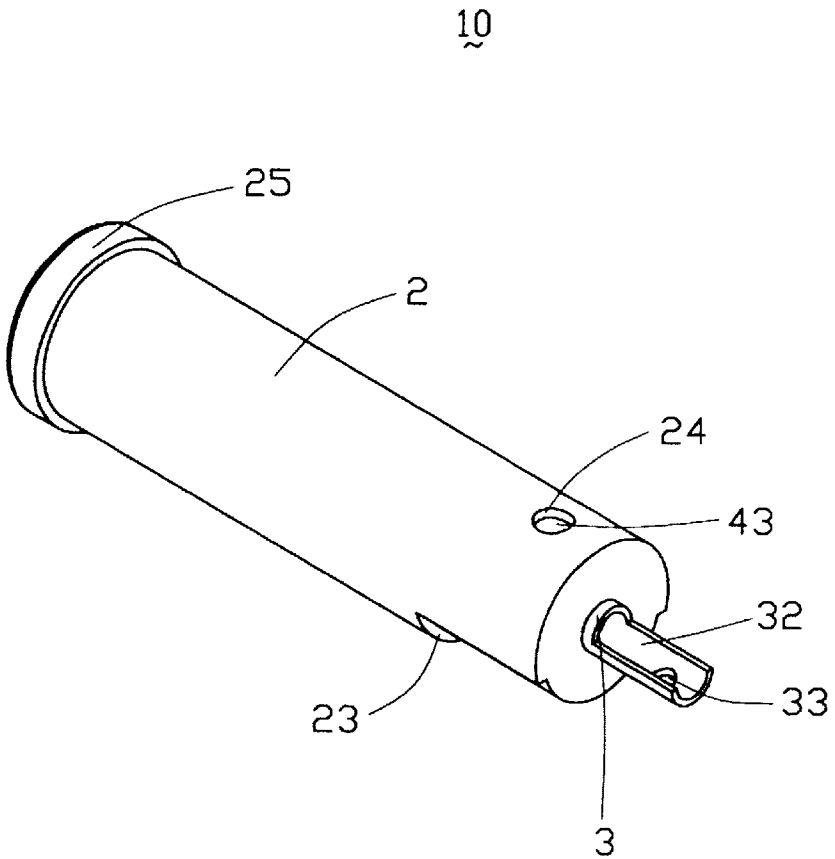
FIG. 4 is a perspective view of the plug connector after inserting molding without showing an outer contact.

FIG. 3 shows the center contact 3 to be generally cylindrical. The center contact 3 has a U shaped tail portion 32 extending beyond the rear end 26, a mating portion 35 extending through the bore 21 into the space 20 for electrically engaging with a corresponding element of the complementary receptacle connector (not shown) and an intermediate portion 31 embedded in the housing 2 and connecting the tail portion 32 and the mating portion 35. The intermediate portion 31 has two spaced grooves 34 recessed from an outer circumferential surface thereof for providing a firm retention between the center contact 3 and the housing 2. The tail portion 32 is formed with an inner surface thereof facing upward and defines an aperture 33 to receive a first conductor of the cable extending therethrough and soldering thereto for transmitting data signals therebetween.

Figure 6:
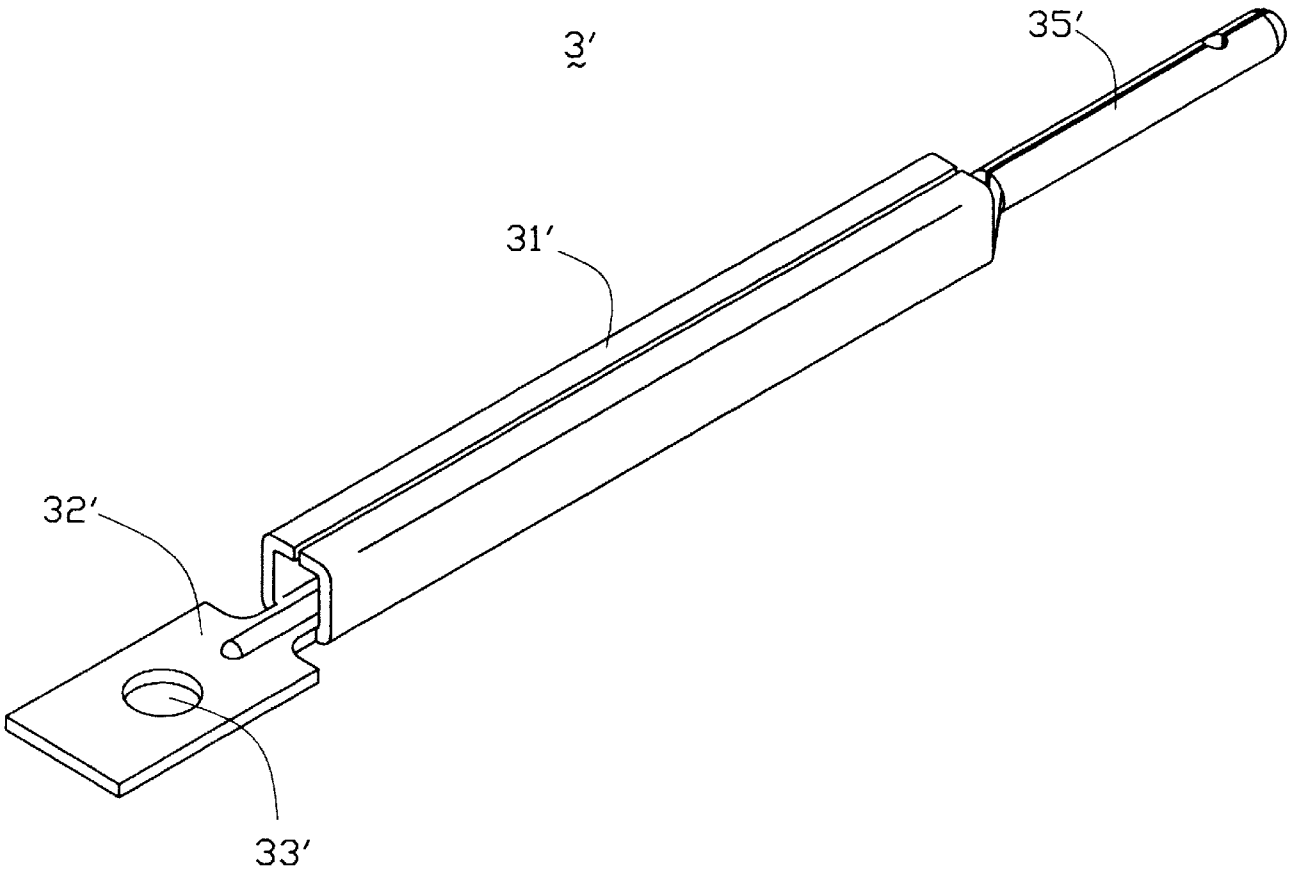
FIG. 6 is a perspective view of a center contact in accordance with a second embodiment of the present invention.

FIG. 6 shows another center contact 3' in accordance with a second embodiment of the present invention. The center contact 3' is stamped and formed from a conductive metal sheet. The center contact 3' has a flat tail portion 32 at a rear end thereof for being soldered to the first conductor of the cable to transmit data signals, a mating portion 35' extending through the bore 21 into the space 20 for electrically engaging with the complementary receptacle connector (not shown) and an intermediate portion 31' embedded in the housing 2 and connecting the tail portion 32' and the mating portion 35'. The mating portion 35' is formed like a cylinder by smoothly bending opposite front edges of the sheet. The intermediate portion 31' is formed like an elongate rectangular box by bending the opposite edges of the sheet. The center contact 3' can be exchangeably used with the center contact 3 for embodying the invention.

Referring to FIG. 5, the inner contact 4 is made of metal and is generally of a hollow cylindrical configuration. The inner contact 4 has opposite front and rear portions 41, 43. The rear portion 43 defines a mating face 42 exposed in the cutout 23 of the housing 2. The inner contact 4 has a circular cross-section. A second conductor of the cable is electrically contacted with mechanically solder to the mating face 42 of the inner contact 4 for transmitting positive power signals.

Figure 7:
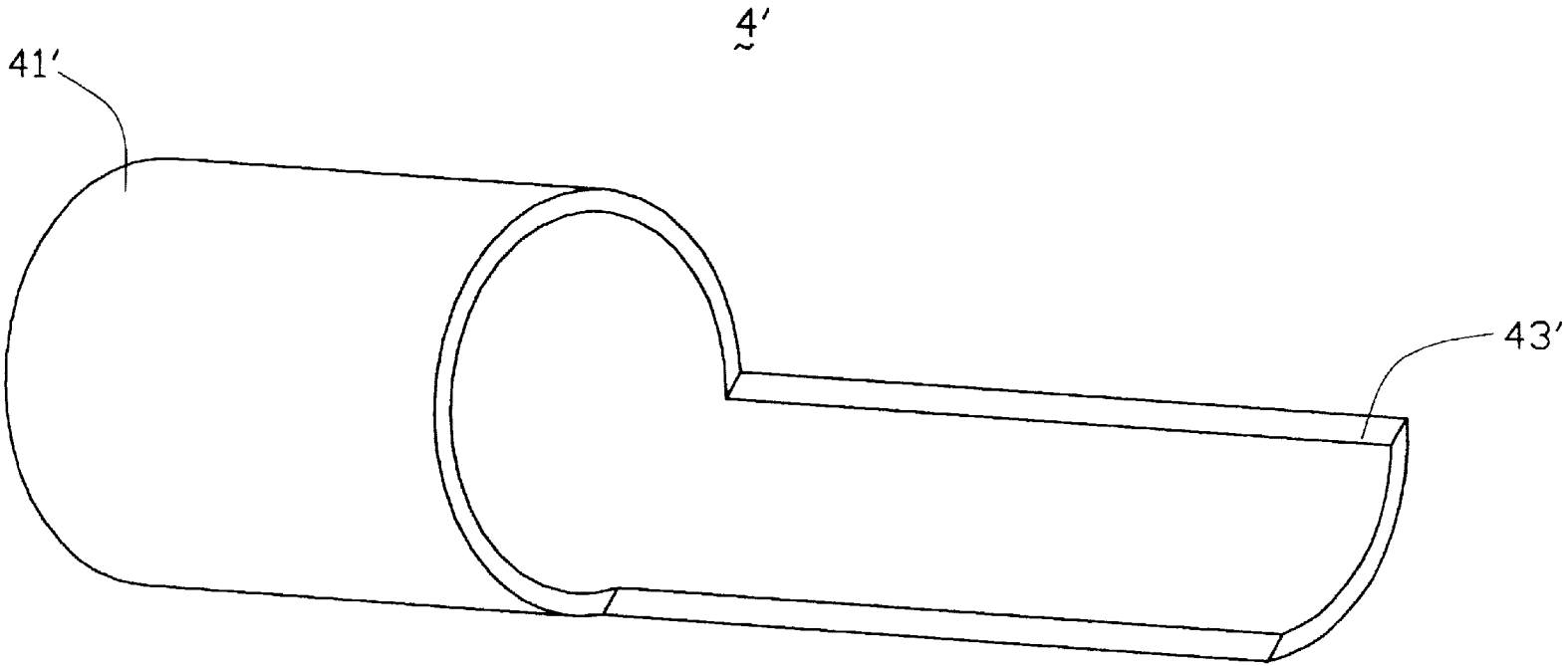
FIG. 7 is a perspective view of an inner contact in accordance with a third embodiment of the present invention.

FIG. 7 shows another inner contact 4' in accordance with a third embodiment of the present invention. The inner contact 4' has a hollow cylindrical front portion 41' and a rear portion 43' extending rearwardly from a lower section of the front portion 41'. The front portion 41' has a circular cross-section, and the rear portion 43' has a U shaped cross section.

Referring to FIGS. 3 and 5, the outer contact 5 is a metal hollow cylinder and telescopes the front end 25 of the housing 2. The outer contact 5 has a reversed U shaped tongue 53 extending from a rear end thereof, a front section 54, and a ring 52 formed on outer surface of the outer contact 5 adjacent to the rear end. The tongue 53 is formed with an inner face thereof facing downwardly opposite to the inner face of the tail portion 32 of the center contact 3. The outer contact 5 is shorter than the inner contact 4. A thickness of the outer contact 5 is substantially equal to a height of the outer protrusion 251 of the front end 25, and a thickness of the inner contact 4 is substantially equal to a height of the inner protrusion 252 of the front end 25. A front section 54 of the outer contact 5 abuts against a surface of the inner protrusion 252 and exposes outwardly at the front end 25 of the housing 2. The tongue 53 has an outer face which is mechanically soldered and electrically connected with a third conductor of the cable for transmitting negative power signals therebetween.

A method for manufacturing the plug connector 1 comprising the steps of: 1) providing a conductive center contact 3 comprising a mating portion 35, an intermediate portion 31 and a tail portion 32; 2) providing a conductive inner contact 4 having a mating face defined on a rear end thereof; 3) inserting the center contact 3 and the inner contact 4 into a mold apparatus; 4) insert molding synthetic resin around the center contact 3 and the inner contact 4 to form a housing 2 thereabout with a space 20 defined in a front end 25 of the housing 2, the mating portion 35 exposed in the space 20 and the housing 2 receiving the tail portion 32 extending therebeyond and exposing the mating face; 5) providing a conductive outer contact 5; 6) enclosing partially the housing 2 with the outer contact 5.

When the plug connector 1 is terminated to the cable, the first conductor of the cable is soldered to the outer surface of the tail portion 32 of the center contact 3, and the second conductor of the cable is soldered to the mating face 42 of the inner contact 4, and the third conductor of the cable is soldered to the outer face of the tongue 53 of the outer contact 5, whereby the outer face of the tongue 53 of the outer contact 5 is opposite to the outer face of tail portion 32 the center contact 3. Therefore, soldering processes to different contacts are separated from each other, and the plug connector 1 achieves a reliable electrical connection with the cable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical plug connector for an electrical cable, comprising:

a center contact comprising a mating portion, a tail portion for being soldered with a first conductor of the electrical cable and an intermediate portion connecting the mating portion with the tail portion;

an inner contact comprising a rear portion defining a mating face for being soldered with a second conductor of the electrical cable;

an insulative housing insert molded with the center contact and the inner contact and exposing the mating face of the inner contact outward; and an outer contact surrounding the housing for being soldered with a third conductor of the electrical cable;

wherein the housing has a hole adjacent to the rear portion of the inner contact to expose the inner contact outwardly for providing a positioning during insert molding process;

wherein the housing has a cutout defined in a rear end thereof, the mating face of the inner contact exposed in the cutout;

wherein the intermediate portion of the center contact includes at least a groove in an outer circumferential surface thereof;

wherein the tail portion of the center contact has a U shaped configuration and faces upward;

wherein the tail portion of the center contact has an aperture for being soldered with the first conductor of the cable;

wherein the outer contact has a reversed U shaped tongue extending from a rear end thereof, and the tongue facing downward opposite to the tail portion of the center contact.

2. The electrical plug connector as claimed in claim 1, wherein the center contact is stamped from a metal sheet.

3. The electrical plug connector as claimed in claim 1, wherein the tail portion is a flat plate.

4. The electrical plug connector as claimed in claim 1, wherein the intermediate portion is formed like an elongated rectangular box.

* * * * *